US006318144B1

(12) United States Patent
Keeble

(10) Patent No.: US 6,318,144 B1
(45) Date of Patent: Nov. 20, 2001

(54) VEHICLE ACCIDENT RESCUE TOOL

(76) Inventor: Timothy E. Keeble, 427 Dairy La., Lenoir City, TN (US) 37772

( * ) Notice: Subject to any disclaimer, the term of this patent is extended or adjusted under 35 U.S.C. 154(b) by 0 days.

(21) Appl. No.: 09/638,361

(22) Filed: Aug. 15, 2000

(51) Int. Cl.[7] ..... B21J 13/08

(52) U.S. Cl. ..... 72/457; 72/301; 72/447; 72/705

(58) Field of Search ..... 72/295, 301, 447, 72/457, 705

(56) References Cited

U.S. PATENT DOCUMENTS

| | | | | |
|---|---|---|---|---|
| 2,852,971 | | 9/1958 | Macaluso. Jr. . | |
| 3,206,966 | | 9/1965 | Fagan et al. . | |
| 3,577,881 | | 5/1971 | Markovics . | |
| 3,729,974 | | 5/1973 | Tidwell . | |
| 3,819,153 | | 6/1974 | Hurst et al. . | |
| 3,891,187 | * | 6/1975 | Bearden, Jr. | 72/705 |
| 3,985,014 | | 10/1976 | Smith . | |
| 4,257,255 | * | 3/1981 | Sanchez | 72/705 |
| 4,732,029 | | 3/1988 | Bertino . | |
| 5,425,260 | | 6/1995 | Gehron . | |
| 5,730,019 | * | 3/1998 | Venalainen | 72/705 |

* cited by examiner

*Primary Examiner*—Ed Tolan
(74) *Attorney, Agent, or Firm*—Pitts & Brittian, P.C.

(57) ABSTRACT

A vehicle accident rescue tool, constructed so as to lift and pull a steering column vertically and horizontally. The rescue tool (10) includes a base (12), a base arm (14) carried by base (12) and, preferably, disposed at a substantially right angle to base (12). Base arm (14) includes a distal end (16) that carries a first actuator anchor point (18) and a stabilizer anchor point (20). Stabilizer anchor point (20) provides a point of attachment for a first detention cable (22) for securing the distal end (16) to a selected point on the vehicle frame. A lifting arm (36) is pivotally attached to base arm (14) and spaced apart from base (12) a selected distance. The distal end (38) of lifting arm (36) carries a second actuator anchor point (40) and an additional anchor point (42). In use, rescue tool (10) is placed on the vehicle with base (12) proximate the steering column and, preferably, positioned over a portion of the vehicle capable of supporting a load. An actuator (44) is operatively engaged with first and second actuator anchor points (18) and (40), respectively, so as to provide a force that pulls lifting arm (36) in a pivoting fashion. Lifting arm (36) is positioned so as to have its distal end angled toward the steering column. A second detention cable (46) is anchored on anchor point (42) carried by lifting arm (36) and secured to the steering column. As actuator (44) causes lifting arm (36) to rotate upwards a vertical position, the steering column is lifted and pulled.

20 Claims, 7 Drawing Sheets

VEHICLE ACCIDENT RESCUE TOOL

CROSS-REFERENCE TO RELATED APPLICATIONS

Not Applicable

STATEMENT REGARDING FEDERALLY SPONSORED RESEARCH OR DEVELOPMENT

Not Applicable

BACKGROUND OF THE INVENTION

1. Field of Invention

This invention relates to a vehicle accident rescue tool. More specifically, it relates to a multi-purpose tool, for use at a vehicle accident scene, primarily useful for lifting and pulling the steering column of a wrecked vehicle. Other uses will be described herein and recognized by those skilled in the art.

2. Description of the Related Art

It is well known that as a result of an automobile accident, involving single or multiple vehicles, accident victims are often trapped within a vehicle. Often times, the driver of the vehicle is pinned between the steering column and the drivers seat. And, a number of devices have been invented for rescuing trapped individuals. Perhaps most notable among the known prior art is the device commonly referred to as the JAWS OF LIFE, described in U.S. Pat. No. 3,819,153, issued to Hurst et al. on Jun. 25, 1974. Other rescue tools known in the art include U.S. Pat. No. 3,577,881, issued to Markovics on May 11, 1971; U.S. Pat. No. 3,985,014, issued to Smith on Oct. 12, 1976; U.S. Pat. No. 4,732,029, issued to Bertino on Mar. 22, 1988; and U.S. Pat. No. 5,425,260, issued to Gehron on Jun. 20, 1995. Other known prior art includes U.S. Pat. No. 2,852,971, issued to Macaluso, Jr. on Sep. 23, 1958; U.S. Pat. No. 3,206,966, issued to Fagan on Sep. 21, 1965; and U.S. Pat. No. 3,729,974, issued to Tidwell on May 1, 1973. Notable of these references are the Bertino reference, (the '029 patent), and the Gehron reference, (the '260 patent). Each of these rescue tools is adapted to be used in conjunction with the JAWS OF LIFE, or other pulling device such as a ratcheting cable winch puller.

Referring to the '260 patent, Gehron's device includes a load bearing base, a base arm fixedly attached to base and a lifting arm pivotably attached to base. It is readily known to those skilled in the art, that in use, the load bearing base must be positioned over a reinforced section of the frame of the automobile, such as over the firewall, immediately forward of the windshield. Those skilled in the art recognize that if the base is positioned over an unsupported portion of, for instance, the hood, the force transferred through the lifting arm to the base will merely crush the hood. It has been learned that the pivotal attachment of the lifting arm to the base only allows the lifting arm to apply lifting force to the steering column as the lifting arm approaches vertical. This limits the vertical displacement of the steering column to a few inches. Further, using the example of placement of the rescue tool on the hood in order to lift the steering column, the Gehron device does lift the steering column a limited vertical distance but in most cases does not pull the steering column in a horizontal direction. Accordingly, there is a need for a vehicle accident rescue tool that simultaneously lifts and pulls a vehicle's steering column through a full range of motion.

It is therefore an object of the present invention to provide a vehicle accident rescue tool that is capable of lifting and pulling a steering column away from an accident victim.

Another object of the present invention is to provide a vehicle accident rescue tool that also provides a readily adaptable configuration for also shielding the interior of the vehicle from an inadvertent deployment of a passenger side airbag.

Still another object of the present invention is to provide a vehicle accident rescue tool that is readily adaptable for use as a mini-boom at an accident scene.

Other objects and advantages over the prior art will become apparent to those skilled in the art upon reading the detailed description together with the drawings as described as follows.

BRIEF SUMMARY OF THE INVENTION

In accordance with the teachings of the present invention a vehicle accident rescue tool is provided that lifts a steering column vertically, and pulls the steering column horizontally so as to free an obstructed accident victim. The rescue tool includes a base, base arm carried by the base, and a lifting arm pivotally engaged with the base arm in spaced relation from the base. The base arm includes a distal end that carries a first actuator anchor point and a second anchor point. The second anchor point provides a point of attachment for a first detention cable for securing the distal end to a selected point on the vehicle frame. In the preferred embodiment, the base arm is defined by a first arm member and an arm extension member that is telescopically received by the first arm member in a manner that is securable and adjustable.

The distal end of the lifting arm carries a second actuator anchor point and an additional anchor point. In use, the rescue tool is placed on the vehicle with the base proximate the steering column and, preferably, positioned over a portion of the vehicle capable of supporting a load. In this regard, the rescue tool is preferably placed over the front end of the vehicle with the base proximate the steering wheel and placed over the firewall/forward edge of the dash, proximate the base of the windshield. The distal end of the base arm is secured to a rigid point of attachment on the vehicle's frame. An actuator, such as a ratcheting cable winch puller, is operatively engaged with the first and second actuator anchor points so as to provide a force that pulls the lifting arm in a pivoting fashion. The distal end of the lifting arm is secured as by a pulling cable to the steering column. As the actuator causes the lifting arm to rotate upwards towards a vertical position, the steering column is lifted and pulled.

In the preferred embodiment, the rescue tool also includes a passenger-side air airbag shredder assembly for protecting a passenger or rescue personnel from injury associated with the inadvertent deployment of the passenger side airbag. In this regard, a lateral extension arm is telescopically received by an end of the base. A riser is slidably carried by the lateral extension arm and supports an adjustable boom arm which in turn carries an airbag shield. The airbag shield carries a plurality of blades for deflating an inadvertently deployed passenger side airbag. The adjustable boom arm is configured to allow ready adjustment for positioning the airbag shield in close proximity to the vehicle's passenger side airbag.

The rescue tool can also be used as a mini-boom for other pulling type operations. In this regard, the arm extension member is telescopically engaged with the lifting arm. In order to stabilize the rescue tool while in use as a mini-boom, a stabilizer arm is provided and is adapted to be telescopically received by the first arm member. Further, the stabilizer arm is adapted to be engaged with a vehicle, such as a rescue vehicle, such that the weight of the vehicle serves to stabilize the rescue tool.

BRIEF DESCRIPTION OF THE SEVERAL VIEWS OF THE DRAWINGS

The above-mentioned features of the invention will become more clearly understood from the following detailed description of the invention read together with the drawings in which.

DETAILED DESCRIPTION OF THE INVENTION

Figure 1:
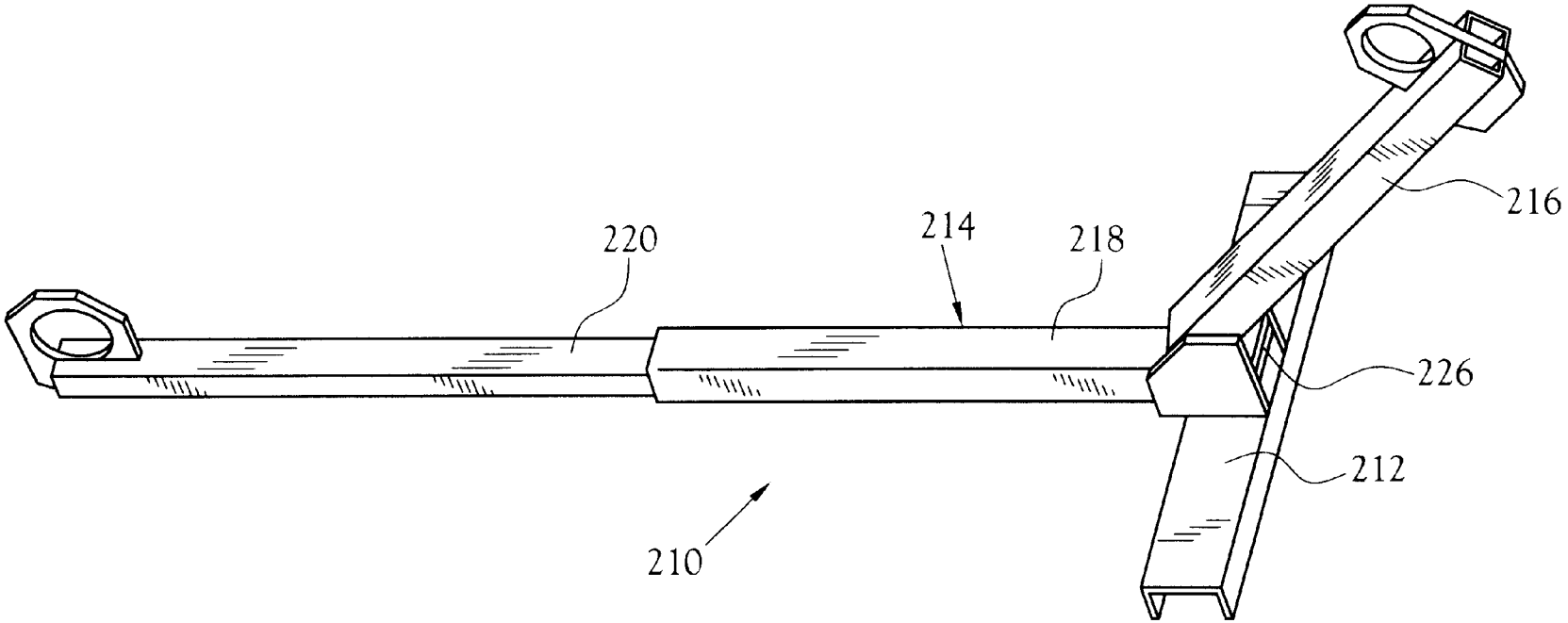
Fig. 1 (PRIOR ART)
FIG. 1 is a perspective view of a prior art rescue tool as substantially taught by U.S. Pat. No. 5,425,260.
Figure 2:
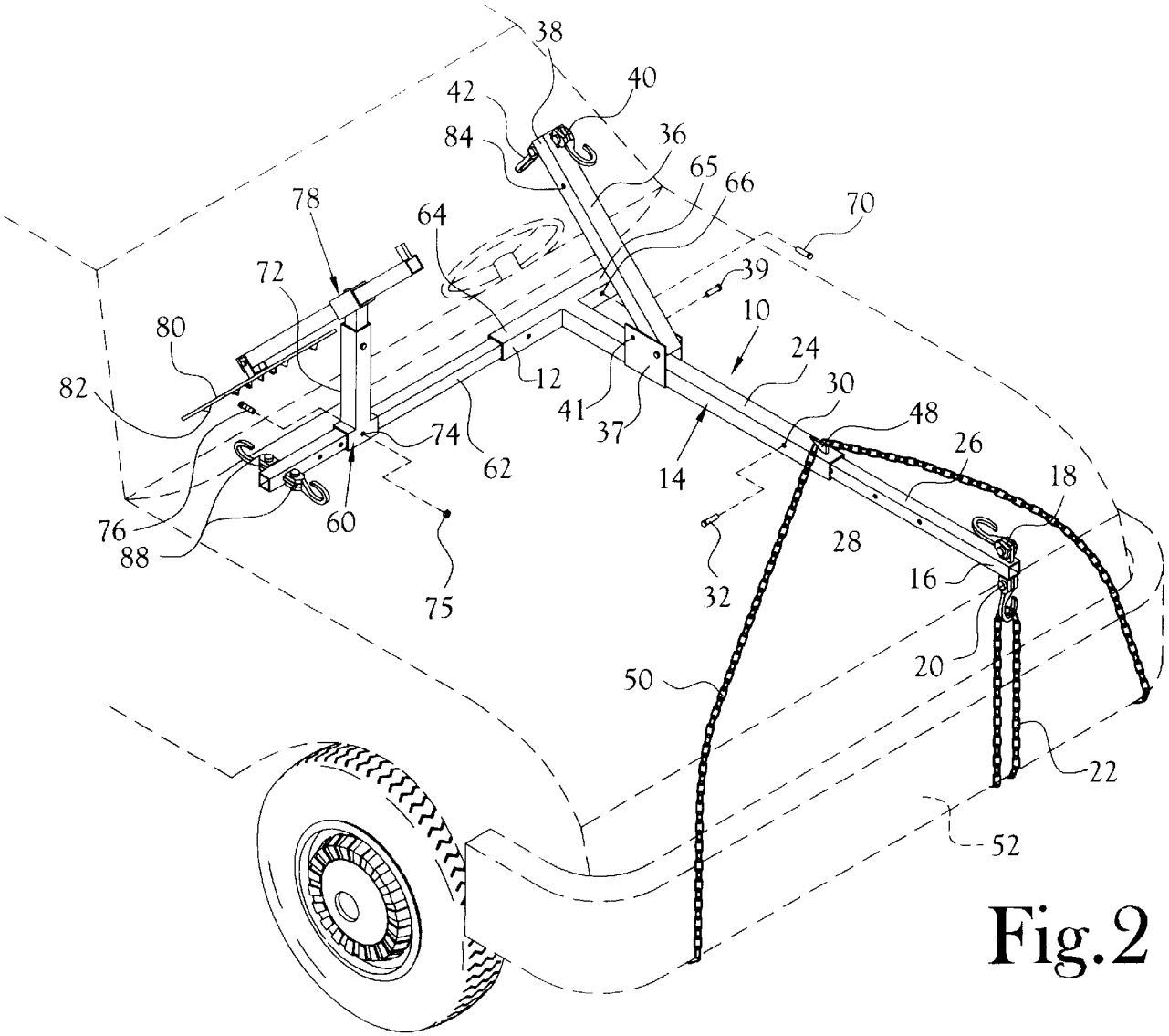
FIG. 2 is a perspective view showing the vehicle accident rescue tool of the present invention in use in association with an automobile, shown in phantom lines.

As seen in FIG. 1, the prior art rescue tool 210, described in U.S. Pat. No. 5,425,260, includes a load bearing base 212, a base arm 214 fixedly attached to base 212 and a lifting arm 216 pivotably attached to base 212. The base arm 214 preferably includes a first member 218 which is that portion of base arm 214 fixedly attached to base 212 and a second member 220 which is telescopically interactive with first member 218. The prior art rescue tool 210 also includes a stop 126 for limiting the downward range of motion of lifting arm 216. It will be recognized that the distal end of the lifting arm 216 does not break the vertical plane of the base 212 prior to reaching a substantially vertical position. Accordingly, the lifting arm 216 only lifts the steering column in a vertical direction. The present invention is intended to overcome this limitation and to provide additional capability to a vehicle accident rescue tool.

Figure 3:
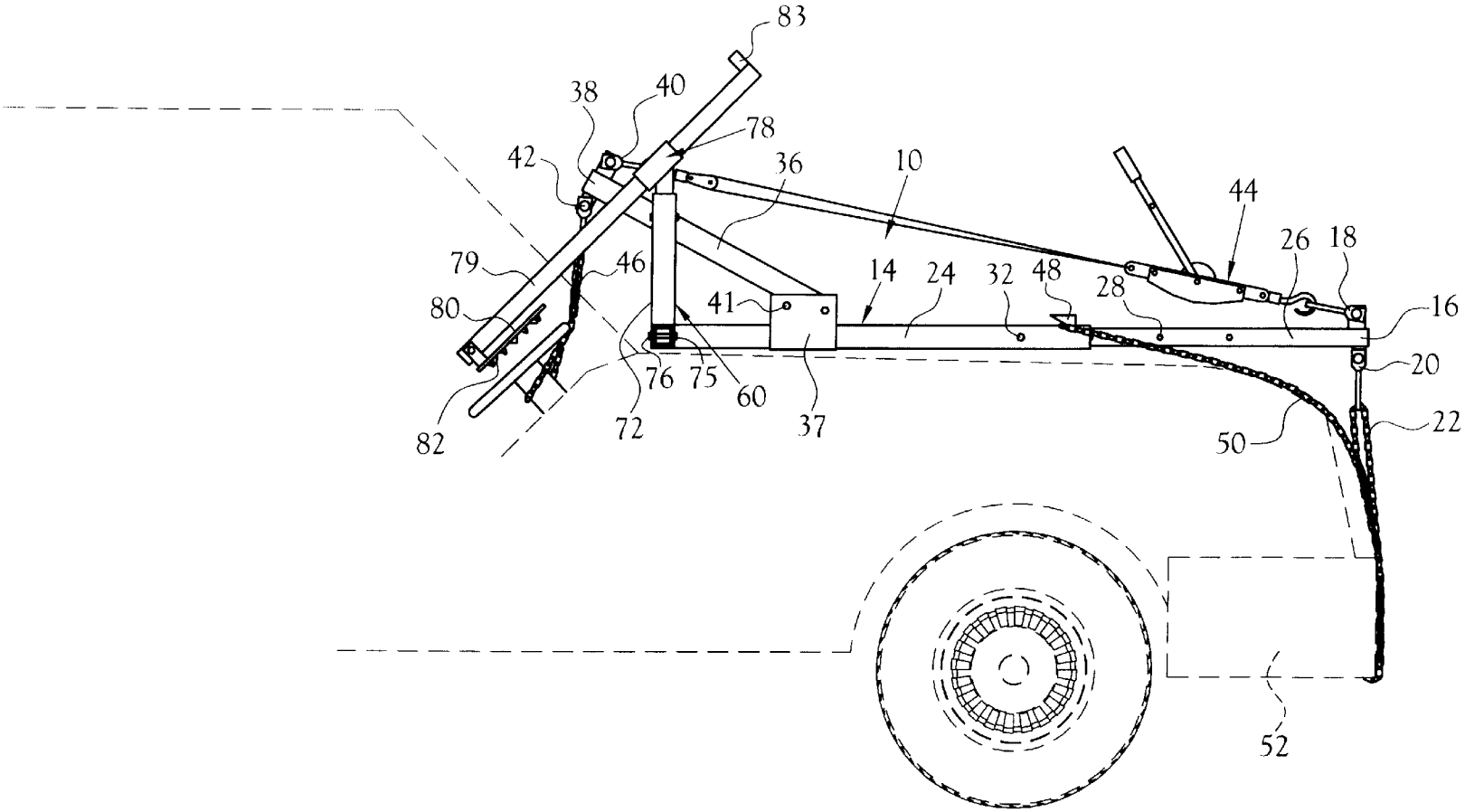
FIG. 3 is a side elevation view of the rescue tool shown in FIG. 2 showing the rescue tool of the present invention having a chain engaged to the vehicle steering wheel.
Figure 4:
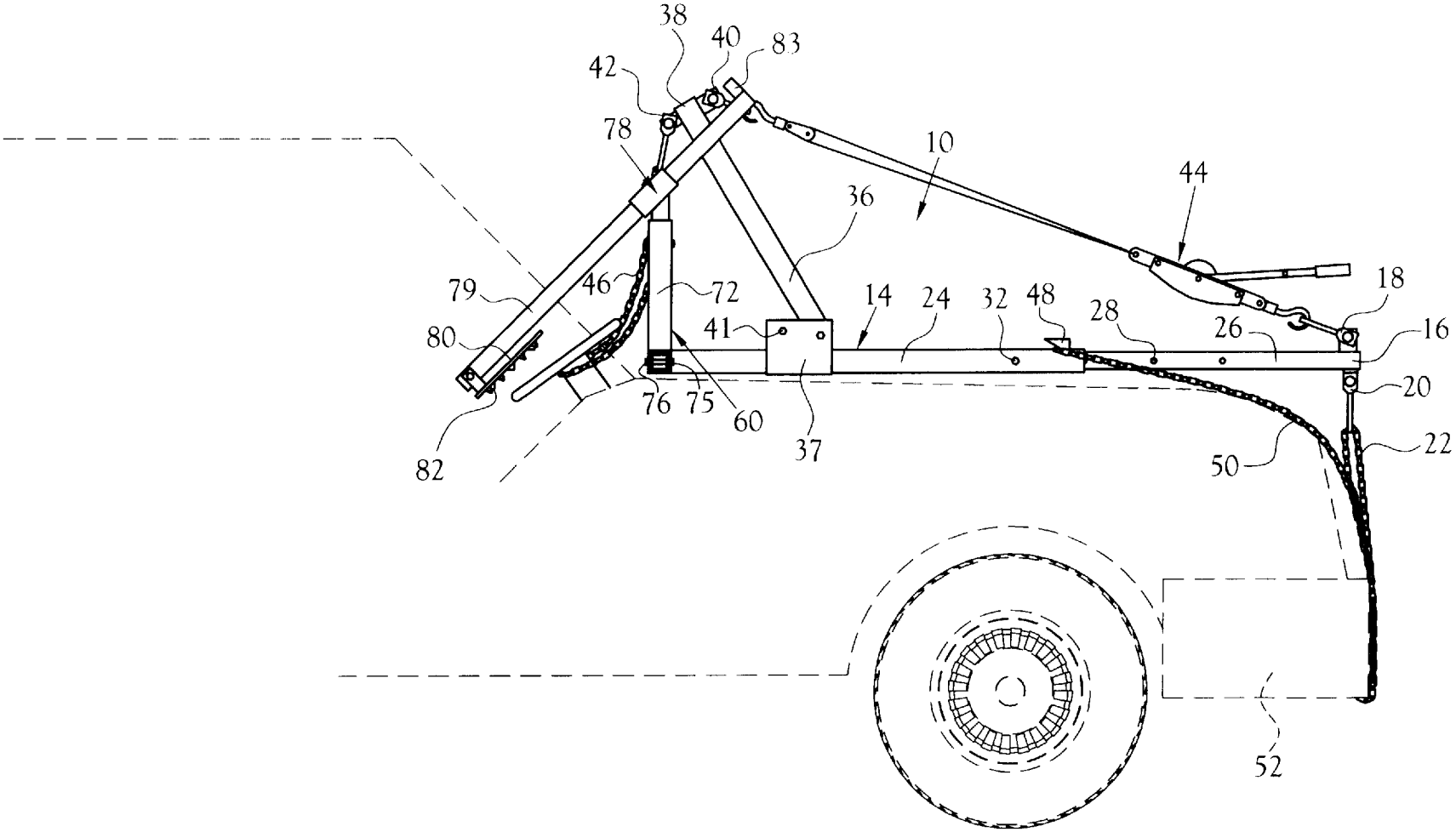
FIG. 4 is a similar view as shown in FIG. 3 showing the steering wheel column pulled upwards and outwards away from the passenger compartment.

A vehicle accident rescue tool, constructed in accordance with the present invention so as to lift a steering column vertically, and pull the steering column horizontally is illustrated generally as 10 in the figures. The rescue tool 10 includes a base 12. A base arm 14 is carried by the base 12 and is, preferably, disposed at a substantially right angle to the base 12. The base arm 14 includes a distal end 16 that carries a first actuator anchor point 18 and a stabilizer anchor point 20. In the preferred embodiment, the first actuator anchor point 18 and the stabilizer anchor point 20 depend from lugs secured to the distal end 16. The stabilizer anchor point 20 provides a point of attachment for a first detention cable 22. Detention cable 22 is defined by a wire cable, chain, rope or similar article and secures the distal end 16 to a selected point on the vehicle frame in order to stabilize the rescue tool 10 during use. In the preferred embodiment, the base arm 14 is defined by a first arm member 24 and an arm extension member 26 that is telescopically received by the first arm member 24. To assure proper securement of first arm member 24 and arm extension member 26, a hole member 30 is provided in first arm member 24 and a plurality of through holes 28, in spaced relation, are located in arm extension member 26, whereby a pin 32 or other means is inserted through hole 30 and a desired hole 28 to lock first arm members 24 and arm extension member 26 in position. In this manner, the effective length of base arm 14 is readily adjustable. A lifting arm 36 is pivotally attached to the base arm 14 by a bracket 37 and spaced apart from the base 12 a selected distance. The distal end 38 of the lifting arm 36 carries a second actuator anchor point 40 and an additional anchor point 42. A removable pin 39 is inserted through through-holes 41 in order to provide a stop for limiting the forward pivoting of the lifting arm 36. The removable pin 39 allows the lifting arm 36 to be stabilized in a fixed starting position thereby allowing for ease of positioning the rescue tool 10. Further, the removable pin 39 can also be removed to allow a full range of motion to the lifting arm 36. It will be appreciated by those skilled in the art that while the anchor points 18, 20, 40 and 42 are illustrated as being hooks, eyes or D-rings would provide suitable anchor points. In use, the rescue tool 10 is placed on the vehicle with the base 12 proximate the steering column and, preferably, positioned over a portion of the vehicle capable of supporting a load. To use the example of pulling the steering wheel towards the windshield, the rescue tool is placed over the front end of the vehicle with the base proximate the steering wheel and placed over the firewall/forward edge of the dash, proximate the base of the windshield. The first detention cable 22 is anchored at stabilizer anchor point 20 and also securely attached to a selected point of attachment on the vehicle's frame. An actuator 44 is operatively engaged with the first and second actuator anchor points 18 and 40, respectively, so as to provide a force that pulls the lifting arm 36 in a pivoting fashion. In the preferred embodiment, the actuator 44 is defined by a ratcheting cable winch puller. However, it will be appreciated that the JAWS OF LIFE can be used as an actuator. Those skilled in the art will appreciate that other actuators could be used to provide a pulling force against lifting arm 36. The lifting arm is positioned so as to have its distal end angled toward the steering column at an acute angle, preferably less than 45°, as shown in FIG. 3. A pulling cable 46 is anchored on the anchor point 42 carried by the lifting aim 36 and secured to the steering column. The pulling cable 46 can be defined by a wire cable, chain, rope or similar article. As the actuator 44 causes the lifting arm 36 to rotate upwards towards a vertical position, the steering column is lifted and pulled, as illustrated in FIG. 4.

In the preferred embodiment, the base 12, the base arm 14 and the lifting arm 36 are constructed of square steel tubing. However, other equivalently strong materials could also be utilized. Additionally, while square tubing is preferred, round tubing could also be utilized.

In addition to serving to lift and pull a steering column away from an accident victim, the vehicle accident rescue tool also serves to protect bystanders from a hazard caused by compressed front bumpers. In this regard, it is recognized that state of the art vehicle bumpers include gas cylinders that in a low speed impact act as shock absorbers and return the bumper to its normal position. However, those skilled in the art recognize that a bumper that has sustained a frontal impact without rebounding is hazardous inasmuch as the gas cylinders are capable of explosively decompressing and propelling the bumper off of the vehicle. In order to address this safety concern, an additional anchor point 48 is provided on the base arm 14. The anchor point 48 receives a second detention cable 50 that has ends that are securable to rigid points of attachment on a vehicle frame proximate the ends of the vehicle's front bumper 52 and preferably pass tightly around the front of the vehicle's front bumper 52. The second detention cable 50 that is anchored on the base arm 14 at the anchor point 48 serves to restrain the bumper from becoming a hazardous projectile.

In order to provide protection to rescue personnel and accident victims from injury caused by an inadvertent deployment of the passenger-side airbag, the rescue tool 10 also includes, in the preferred embodiment, a passenger-side air airbag shredder assembly 60. In this regard, a lateral extension arm 62 is telescopically received by a first end 64 of base 12. To assure proper securement of base 12 and lateral extension arm 62, a hole member 66 is provided in a second end 65 of base 12 and a through holes (not shown) 68 is provided in the distal end of lateral extension arm 62, whereby a pin 70 or other means is inserted through hole 66 and the hole 68 to lock base 12 and lateral extension arm 62 in position. A riser 72 is slidably carried by the lateral extension arm 62. In a fashion similar as described above, the riser 72 includes a hole member 74 that is registrable with a selected hole 68 and a pin 76 or similar member is inserted through hole 74 and a selected hole member 74 to secure the riser 72 in a selected position proximate a passenger side airbag. In the preferred embodiment, a nut 75 is fixedly secured, as by welding or similar means, to the riser 72 so as to register with hole member 74 and threadably receive pin 76. The riser supports an adjustable boom arm 78, which is secured to the riser 72 in similar fashion as the riser 72 is secured to the lateral extension arm 62. The boom arm 78, in turn supports a shield arm 79 which carries an airbag shield 80. The shield arm 79 is secured to the boom arm in similar fashion as the riser 72 is secured to the lateral extension arm 62. The airbag shield 80 carries a plurality of cutting or piercing edges 82 for deflating an inadvertently deployed airbag (not shown). The adjustable boom arm 78 is configured to allow ready adjustment for positioning the airbag shield 80 in close proximity to the vehicle's passenger side airbag. As seen in FIGS. 3 and 4, the airbag shield 80 is pivotally attached to the shield arm 79 in an offset manner such that the force of an inadvertently deployed airbag's impact will cause the airbag shield 80 to pivot into, and strike, the shield arm 79. In the preferred embodiment, a lug 83 is secured to the distal end of the shield arm 79 in order to prevent the shield arm 79 from falling through the boom arm 78 during adjustment of the airbag shredder assembly 60. Also, in the preferred embodiment, lugs 88 are disposed at the distal end of the lateral extension arm 62 in order to provide additional anchor points.

Figure 5:
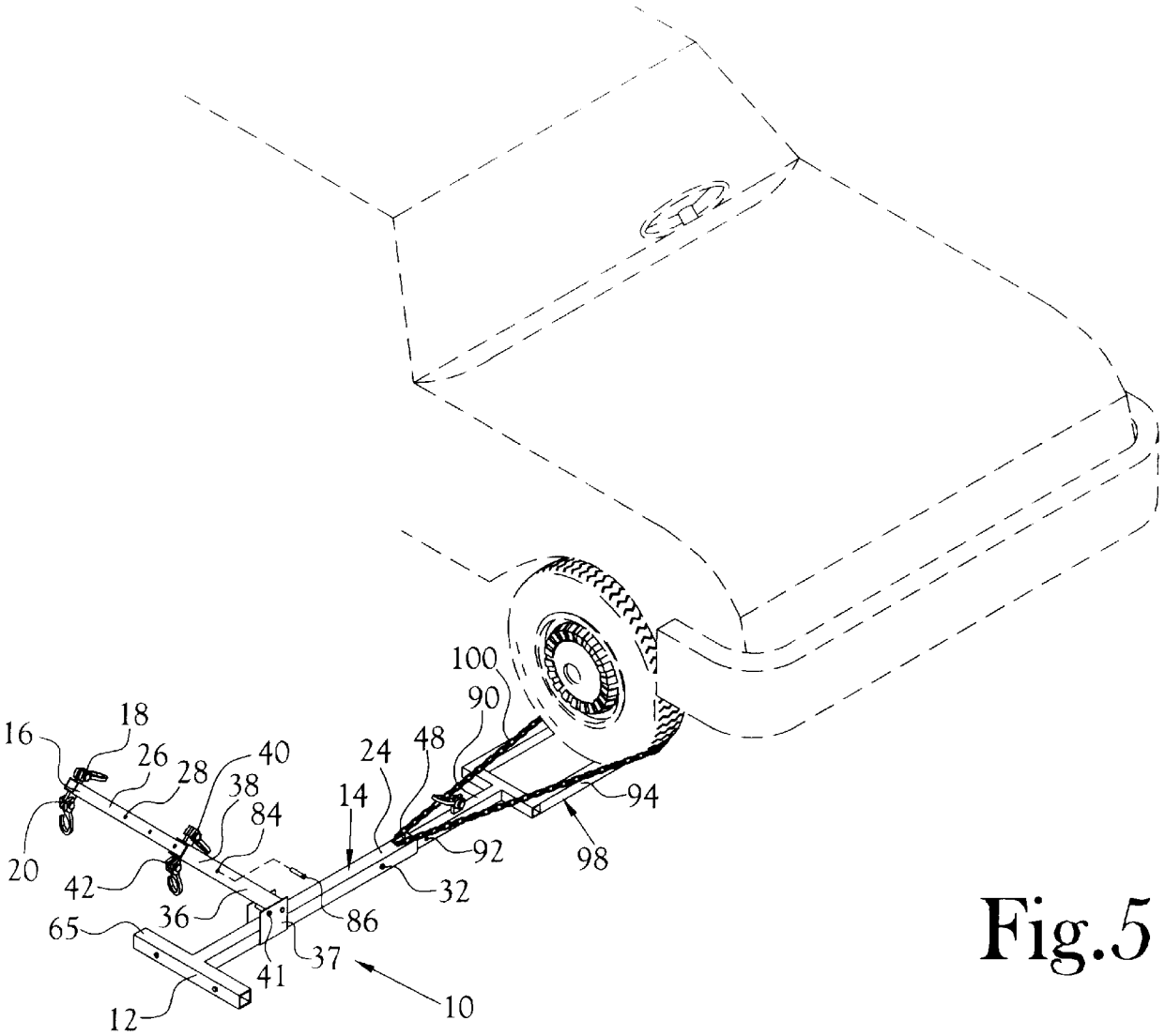
FIG. 5 is a perspective view of the rescue tool of the present invention showing the rescue tool being used with a separate component of the rescue tool for use as a mini-boom.
Figure 6A:
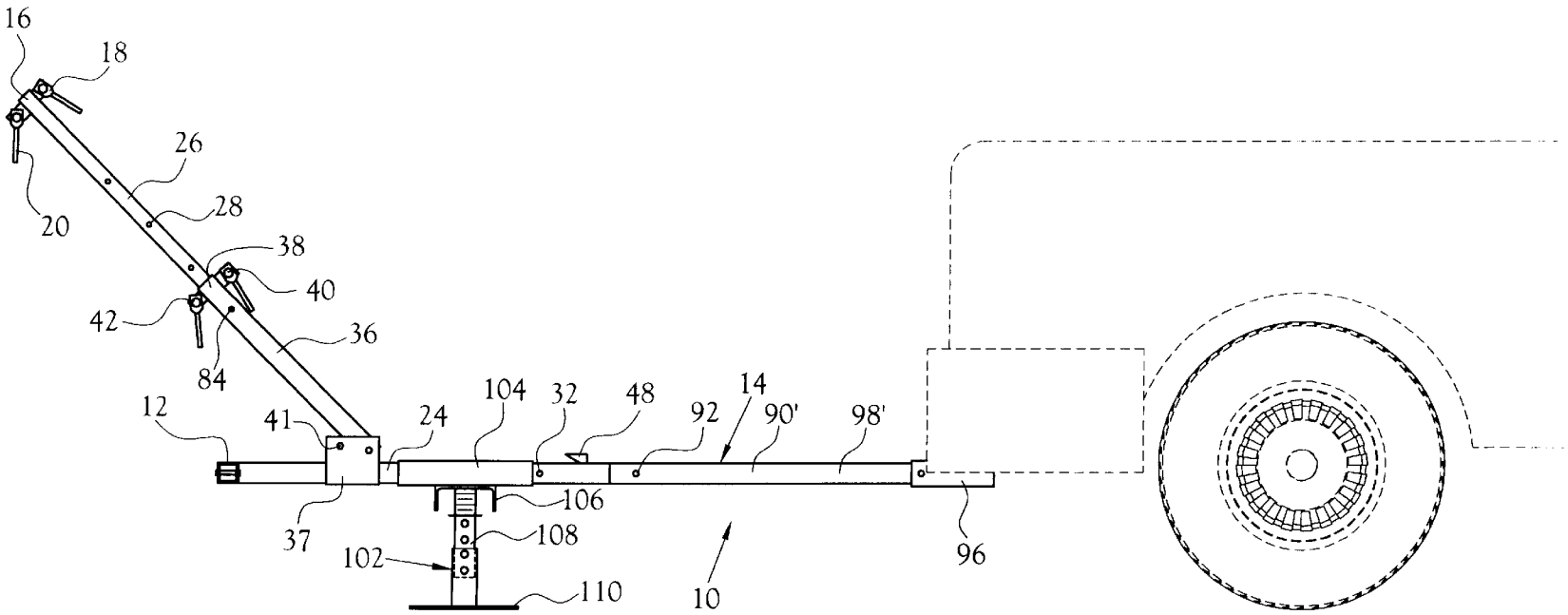
FIG. 6*a* is a side elevation view showing yet another accessory component of the rescue tool of the present invention that allows the rescue tool to be used as a mini-boom in conjunction with a standard hitch receiver.
Figure 6B:
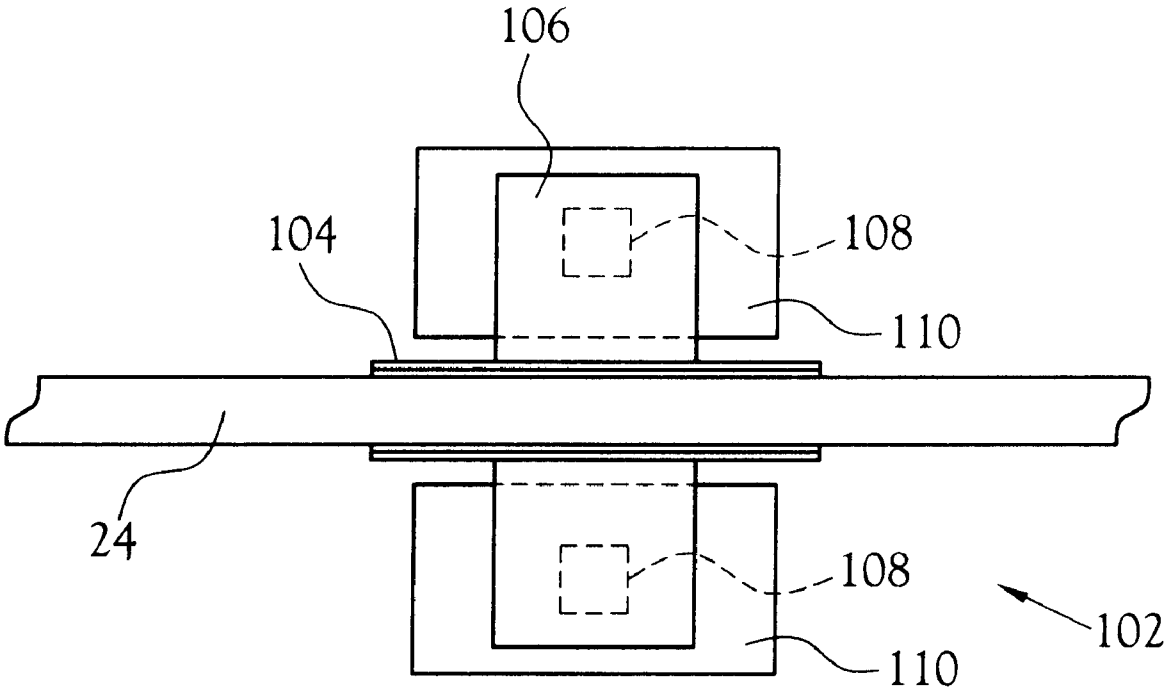
FIG. 6*b* is a partial top view of the embodiment illustrated in FIG. 6*a* showing a preferred stanchion support.

The rescue tool 10 can also be used as a mini-boom for other pulling type operations. In this regard, as illustrated in FIGS. 5 and 6, the arm extension member 26 is removed from its telescoping engagement with the first arm member 24 and telescopically engaged with the lifting arm 36 in similar fashion. In this regard, a hole member 84 is provided in the distal end 38 of the lifting arm 36. A pin 86 or similar member is inserted through hole member 84 and a selected hole 28 in order to secure the arm extension member 26 to the lifting arm 36. Alternatively, the lateral extension arm 62 can be telescopically engaged with the lifting arm in similar fashion. In order to stabilize the rescue tool 10 while in use as a mini-boom, a stabilizer arm 90 is provided and is adapted to be telescopically received by the first arm member 24. Further, stabilizer arm 90 has a distal end 98 that is adapted to be engaged with a vehicle, such as a rescue vehicle, such that the weight of the vehicle serves to stabilize the rescue tool 10. To assure proper securement of first arm member 24 and stabilizer arm 90, at least one through hole 92, is located in stabilizer arm 90, whereby the pin 32 or other means is inserted through hole 30 and a desired hole 92 to lock first arm members 24 and stabilizer arm 90 in position. In the embodiment illustrated in FIG. 5, the distal end 98 of the stabilizer arm 90 has a forked configuration that includes a pair of arm members 94, in spaced relation and preferably parallel, that are adapted to be engaged by a vehicle tire. In this embodiment, a safety detention cable 100 is wrapped around the vehicle tire and anchored on anchor point 48 to secure the rescue tool 10 in place.

In an alternate embodiment illustrated in FIG. 6, the distal end 98' of the stabilizer arm 90' is adapted to be received in a standard Type II trailer hitch receiver 96. In this embodiment, a stanchion assembly 102 is provided in order to support the rescue tool 10 during use as a mini-boom. A preferred stanchion assembly 102 is defined by an elongated channel member 104 for receiving, and supporting, first arm member 24. An plate member 106 depends from the channel member 104. Plate member 106 is preferably defined by an inverted channel and is disposed perpendicularly to the elongated channel member 104. A pair of adjustable leg members 108 engage the plate member 106 and thereby provide support. Preferably, in order to increase the surface area of the end of each leg member 108 that engages a surface such as the ground, a base 110 is provided on each leg member 108. It will be appreciated that other devices can be utilized as a stanchion assembly 102 for supporting the rescue tool 10 during use, such as a cribbing, or an hydraulic floor jack or axle jack, or axle stands.

From the foregoing description, it will be recognized by those skilled in the art that a vehicle accident rescue tool that simultaneously lifts and pulls a vehicle's steering column through a full range of motion offering advantages over the prior art has been provided. Specifically, the vehicle accident rescue tool provides a rescue tool that is capable of lifting and pulling a steering column away from an accident victim and that also provides a readily adaptable configuration for also shielding the interior of the vehicle from an inadvertent deployment of a passenger side airbag. Further, the rescue tool of the present invention provides a vehicle accident rescue tool that is readily adaptable for use as a mini-boom at an accident scene.

While a preferred embodiment has been shown and described, it will be understood that it is not intended to limit the disclosure, but rather it is intended to cover all modifications and alternate methods falling within the spirit and the scope of the invention as defined in the appended claims.

Having thus described the aforementioned invention, we claim:

1. A vehicle accident rescue tool for rescuing an obstructed victim of a vehicle accident, said vehicle accident rescue tool comprising;

a base;

a base arm carried by said base, said base arm including a distal end having a first actuator anchor point engageable by an actuator, wherein said distal end of said base arm further includes a stabilizer anchor point engageable by a first detention cable such that said distal end of said base arm is securable to a rigid point of attachment on a vehicle frame; and a lifting arm pivotally engaged with said base arm and in spaced relation from said base, said lifting arm including a distal end having a second actuator anchor point engageable by the actuator and a pulling cable anchor point engageable by a pulling cable such that said lifting arm is securable to a vehicle steering column, whereby said distal end of said lifting arm breaks a vertical plane of said base prior to reaching a substantially vertical position.

2. The vehicle accident rescue tool of claim 1 wherein said base arm is substantially perpendicular to said base.

3. The vehicle accident rescue tool of claim 1 wherein said first detention cable and said pulling cable are constructed of a material selected from a group consisting of wire cable, chain and rope.

4. The vehicle accident rescue tool of claim 1 wherein said base arm is defined by a first arm member carried by said base and an arm extension member telescopically received by said first arm member.

5. The vehicle accident rescue tool of claim 1 wherein said base, said base arm and said lifting arm are constructed of square tubing.

6. The vehicle accident rescue tool of claim 1 wherein said base arm includes an additional anchor point engageable by a second detention cable for restraining a bumper of the vehicle.

7. The vehicle accident rescue tool of claim 1 wherein said vehicle accident rescue tool further comprises;

a lateral extension arm telescopically received by an end of said base;

a riser slidably carried by said lateral extension;

an adjustable boom arm supported by said riser; and an airbag shredder member carried by an end of said adjustable boom arm whereby said airbag shredder member is positionable proximate a passenger side airbag so as to substantially prevent injury resulting from an inadvertent deployment of the passenger side airbag.

8. The vehicle accident rescue tool of claim 1 wherein said arm extension member is telescopically receivable by said lifting arm and said vehicle accident rescue tool further comprises a stabilizer arm having a distal end, wherein said stabilizer arm is telescopically receivable by said first arm member and said distal end of said stabilizer arm is engageable by a vehicle so as to stabilize said vehicle accident rescue tool and said vehicle accident rescue tool is operable as a mini-boom.

9. The vehicle accident rescue tool of claim 8 wherein said distal end of said stabilizer arm is receivable by a Type II hitch receiver.

10. The vehicle accident rescue tool of claim 8 wherein said distal end of said stabilizer arm has a forked configuration defined by a pair of arm members, in spaced relation, wherein said pair of arm members is engageable by a vehicle tire.

11. A vehicle accident rescue tool for rescuing an obstructed victim of a vehicle accident, said vehicle accident rescue tool comprising;

a base;

a base arm carried by said base, said base arm including a distal end having a first actuator anchor point engageable by an actuator, wherein said distal end of said base arm further includes a stabilizer anchor point engageable by a first detention cable such that said distal end of said base arm is securable to a rigid point of attachment on a vehicle frame and an additional anchor point engageable by a second detention cable for restraining a bumper of the vehicle;

lifting arm pivotally engaged with said base arm and in spaced relation from said base, said lifting arm including a distal end having a second actuator anchor point engageable by the actuator and a pulling cable anchor point engageable by a pulling cable such that said lifting arm is securable to a vehicle steering column;

a lateral extension arm telescopically received by an end of said base;

a riser slidably carried by said lateral extension;

an adjustable boom arm supported by said riser; and an airbag shredder member carried by an end of said adjustable boom arm whereby said airbag shredder member is positionable proximate a passenger side airbag so as to substantially prevent injury resulting from an inadvertent deployment of the passenger side airbag.

12. The vehicle accident rescue tool of claim 11 wherein said base arm is substantially perpendicular to said base.

13. The vehicle accident rescue tool of claim 11 wherein said first detention cable and said pulling cable are constructed of a material selected from a group consisting of wire cable, chain and rope.

14. The vehicle accident rescue tool of claim 11 wherein said base arm is defined by a first arm member carried by said base and an arm extension member telescopically received by said first arm member.

15. The vehicle accident rescue tool of claim 11 wherein said base, said base arm and said lifting arm are constructed of square tubing.

16. A vehicle accident rescue tool for rescuing an obstructed victim of a vehicle accident, said vehicle accident rescue tool comprising;

a base;

a base arm carried by said base, said base arm including a distal end having a first actuator anchor point engageable by an actuator, wherein said distal end of said base arm further includes a stabilizer anchor point engageable by a first detention cable such that said distal end of said base arm is securable to a rigid point of attachment on a vehicle frame and an additional anchor point engageable by a second detention cable for restraining a bumper of the vehicle, and further wherein said base arm is defined by a first arm member carried by said base and an arm extension member telescopically received by said first arm member;

a lifting arm pivotally engaged with said base arm and in spaced relation from said base, said lifting arm including a distal end having a second actuator anchor point engageable by the actuator and a pulling cable anchor point engageable by a pulling cable such that said lifting arm is securable to a vehicle steering column, whereby said distal end of said lifting arm breaks a vertical plane of said base prior to reaching a substantially vertical position; and wherein said arm extension member is telescopically receivable by said lifting arm and said vehicle accident rescue tool further comprises a stabilizer arm having a distal end, wherein said stabilizer arm is telescopically receivable by said first arm member and said distal end of said stabilizer arm is engageable by a vehicle so as to stabilize said vehicle accident rescue tool and said vehicle accident rescue tool is operable as a mini-boom.

17. The vehicle accident rescue tool of claim 16 wherein said base arm is substantially perpendicular to said base.

18. The vehicle accident rescue tool of claim 16 wherein said distal end of said stabilizer arm is receivable by a Type II hitch receiver.

19. The vehicle accident rescue tool of claim 16 wherein said distal end of said stabilizer arm has a forked configuration defined by a pair of arm members, in spaced relation, wherein said pair of arm members is engageable by a vehicle tire.

20. The vehicle accident rescue tool of claim 16 wherein said detention cables and said pulling cable are constructed of a material selected from a group consisting of wire cable, chain and rope.

* * * * *